US010190185B2

(12) United States Patent
Matsui et al.

(10) Patent No.: US 10,190,185 B2
(45) Date of Patent: Jan. 29, 2019

(54) HARDENING METHOD OF ANNULAR WORKPIECE

(71) Applicant: JTEKT CORPORATION, Osaka-shi, Osaka (JP)

(72) Inventors: Towako Matsui, Osaka (JP); Tsuyoshi Mikami, Yamatotakada (JP); Katsuhiko Kizawa, Osaka (JP)

(73) Assignee: JTEKT CORPORATION, Osaka (JP)

( * ) Notice: Subject to any disclaimer, the term of this patent is extended or adjusted under 35 U.S.C. 154(b) by 266 days.

(21) Appl. No.: 15/235,643

(22) Filed: Aug. 12, 2016

(65) Prior Publication Data

US 2017/0058374 A1 Mar. 2, 2017

(30) Foreign Application Priority Data

Aug. 24, 2015 (JP) ..... 2015-164994
Jul. 12, 2016 (JP) ..... 2016-137978

(51) Int. Cl.
*C21D 9/08* (2006.01)
*C21D 1/18* (2006.01)
*C21D 1/60* (2006.01)

(52) U.S. Cl.
CPC ..... *C21D 9/085* (2013.01); *C21D 1/18* (2013.01); *C21D 1/60* (2013.01)

(58) Field of Classification Search
CPC ..... C21D 1/667; C21D 9/085
See application file for complete search history.

(56) References Cited

U.S. PATENT DOCUMENTS

2003/0098106 A1* 5/2003 Rabinovich ..... C21D 1/667 148/712
2014/0367898 A1* 12/2014 Hebert ..... C21D 9/0025 266/44
2017/0058374 A1* 3/2017 Matsui ..... C21D 9/085

FOREIGN PATENT DOCUMENTS

JP 2014-062308 A 4/2014

* cited by examiner

*Primary Examiner* — Scott R Kastler
(74) *Attorney, Agent, or Firm* — Oliff PLC

(57) ABSTRACT

A hardening method for an annular workpiece made of metal includes a heating process that heats the annular workpiece to a hardening temperature; an analyzing process that obtains a diameter of the annular workpiece heated to the hardening temperature, and divides the heated annular workpiece into at least a small diameter portion and a large diameter portion based on the obtained diameter; and a cooling process that injects cooling liquid under an injection condition toward the annular workpiece that has been divided into at least the large diameter portion and the small diameter portion in the analyzing process such that a dimensional difference between the large diameter portion and the small diameter portion decreases, the injection condition for the large diameter portion being different from the injection condition for the small diameter portion.

10 Claims, 5 Drawing Sheets

HARDENING METHOD OF ANNULAR WORKPIECE

INCORPORATION BY REFERENCE

The disclosure of Japanese Patent Application No. 2015-164994 and 2016-137978 filed on Aug. 24, 2015 and Jul. 12, 2016 including the specification, drawings and abstract is incorporated herein by reference in its entirety.

BACKGROUND OF THE INVENTION

1. Field of the Invention

The invention relates to a hardening method of an annular workpiece made of metal.

2. Description of Related Art

A bearing ring mainly made of steel of a rolling bearing, for example, as an annular member uses steel for a bearing, such as bearing steel or carburized steel. In order to give the bearing ring the desired mechanical strength, heat treatment such as hardening (quenching) must be applied to the annular workpiece. When the annular workpiece is hardened, the roundness deteriorates, and dimensional variation of the outer diameter and the inner diameter increases, which is problematic.

As a method for suppressing variation of the outer diameter and inner diameter of the annular workpiece, Japanese Patent Application Publication No. 2014-62308 (JP 2014-62308 A), for example, proposes a method that involves performing hardening treatment using a hardening device that includes an outer periphery restraining device that restricts deformation of the annular member toward the radial outside by abutting against an outer peripheral surface of the annular member, and an inner periphery restraining device that restricts deformation of the annular member toward the radial inside by abutting against an inner peripheral surface of the annular member

SUMMARY OF THE INVENTION

While the method described in JP 2014-62308 A can be expected to avoid an increase in the dimensional variation and deterioration of the roundness of the annular member after hardening, it cannot be expected to avoid an increase in cost due to the fact that the restraining devices must be provided separately, which is problematic. Also, the restraining devices must be changed according to the size (model number) of the annular member, so the setup of the hardening device must be changed each time the size of the annular member changes. Therefore, it is difficult to respond quickly to hardening annular members of different sizes.

The invention thus provides a hardening method that enables hardening treatment that enables an increase in dimensional variation, and a deterioration of the roundness, of an annular workpiece after hardening to be avoided, to be performed at a low cost, and that is also able to respond quickly to changes in the size and the like of the annular workpiece to be hardened.

A first aspect of the invention relates to a hardening method for an annular workpiece made of metal that includes a heating process that heats the annular workpiece to a hardening temperature; an analyzing process that obtains a diameter of the annular workpiece heated to the hardening temperature, and divides the heated annular workpiece into at least a small diameter portion and a large diameter portion based on the obtained diameter; and a cooling process that injects cooling liquid under an injection condition toward the annular workpiece that has been divided into at least the large diameter portion and the small diameter portion in the analyzing process such that a dimensional difference between the large diameter portion and the small diameter portion decreases, the injection condition for the large diameter portion being different from the injection condition for the small diameter portion.

An annular workpiece for manufacturing a bearing ring or the like has residual stress generated in a previous process (e.g., a forging process or a turning process or the like) for manufacturing the annular workpiece to be hardened in the invention, in the annular workpiece. When heating the annular workpiece that has such residual stress, the annular workpiece thermally expands while releasing the residual stress. Therefore, deformation (strain) according to the distribution of the residual stress is generated in the annular workpiece that has been heated to a hardening temperature, and as a result, the roundness of the annular workpiece decreases. Also, in the hardening treatment, the diameter of the annular workpiece changes as the temperature of the annular workpiece drops in a cooling process that cools the annular workpiece heated to the hardening temperature. At this time, the manner in which the diameter of the annular workpiece changes differs depending on the cooling condition.

With the hardening method according to the first aspect, the annular workpiece in which deformation (strain) was generated when the annular workpiece was heated to the hardening temperature is divided into at least a large diameter portion and a small diameter portion, and in the cooling process thereafter, the annular workpiece is cooled by injecting cooling liquid under an injection condition that is different for the large diameter portion than for the small diameter portion, such that a dimensional difference between the large diameter portion and the small diameter portion decreases. In this way, by adjusting the cooling condition of the annular workpiece, in the cooling process, the annular workpiece is able to be deformed such that the deformation (strain) according to the distribution of the residual stress generated when the annular workpiece was heated to the hardening temperature is eliminated. As a result, a hardened product with good roundness and little dimensional variation is able to be obtained.

Also, with the hardening method according to the first aspect, the diameter of the annular workpiece heated to the hardening temperature is obtained, and the cooling condition is adjusted according to the obtained diameter. Therefore, suitable hardening treatment is able to be applied at a low cost to an arbitrary annular workpiece, regardless of the shape, size, or model number, or the like, of the annular workpiece to be hardened. Furthermore, it is also possible to respond quickly to changes in the size and the like of an annular workpiece to be hardened.

A second aspect of the invention relates to a hardening method for an annular workpiece made of metal that includes a first heating process that heats the annular workpiece to a temperature at which stress in the annular workpiece is released; an analyzing process that obtains a diameter of the annular workpiece heated to the temperature that releases stress, and divides the heated annular workpiece into at least a small diameter portion and a large diameter portion based on the obtained diameter; a second heating process that heats the annular workpiece that has been divided into at least the large diameter portion and the small diameter portion in the analyzing process to a hardening temperature; and a cooling process that injects cooling liquid under an injection condition toward the annular workpiece that has been heated to the hardening temperature such that a dimensional difference between the large diameter portion and the small diameter portion decreases, the injection condition for the large diameter portion being different from the injection condition for the small diameter portion.

As described above, when heating the annular workpiece for manufacturing a bearing ring or the like, the annular workpiece thermally expands while releasing the residual stress. Therefore, deformation (strain) according to the distribution of the residual stress is generated in the heated annular workpiece, and as a result, the roundness of the annular workpiece decreases. At this time, the annular workpiece initially thermally expands while releasing the residual stress, and thus thermally expands with the deformation (strain) according to the distribution of the residual stress, but after the residual stress is released, the annular workpiece thermally expands substantially uniformly. The temperature at which stress in the annular workpiece is released also depends on the material of the annular workpiece and the like. For example, when the annular workpiece is made of bearing steel, the stress remaining in the annular workpiece is substantially released at a temperature of approximately 500 to 700° C.

With the hardening method according to the second aspect, after the annular workpiece is heated to the temperature at which stress in the annular workpiece is released (hereinafter, this temperature may also be referred to as the "stress release temperature") in the first heating process, the annular workpiece that has been heated to the stress release temperature is divided into the large diameter portion and the small diameter portion. Then, after the annular workpiece is heated to the hardening temperature via the second heating process, the annular workpiece is cooled by injecting cooling liquid under an injection condition that is different for the large diameter portion than for the small diameter portion, such that a dimensional difference between the large diameter portion and the small diameter portion decreases, in the cooling process. In this way, by adjusting the cooling condition of the annular workpiece, in the cooling process, the annular workpiece is able to be deformed such that the deformation (strain) according to the distribution of the residual stress generated when the annular workpiece was heated is eliminated. As a result, a hardened product with good roundness and little dimensional variation is able to be obtained.

Also, with the hardening method according to the second aspect, the diameter of the annular workpiece heated to the temperature at which stress is released is obtained, and the cooling condition is adjusted according to the obtained diameter. Therefore, suitable hardening treatment is able to be applied at a low cost to an arbitrary annular workpiece, regardless of the shape, size, or model number, or the like, of the annular workpiece to be hardened. Furthermore, it is also possible to respond quickly to changes in the size and the like of an annular workpiece to be hardened.

Moreover, with the hardening method according to the second aspect, after heating the annular workpiece to the temperature at which stress is released in the first heating process, the annular workpiece is divided into at least the small diameter portion and the large diameter portion, and then the annular workpiece is heated to the hardening temperature in the second heating process. In this case, the analyzing process ends at the point when the annular workpiece is heated to the hardening temperature. Therefore, the annular workpiece that is heated to the hardening temperature is able to be moved to the cooling process immediately after being heated. When hardening an annular workpiece made of steel, it is important that the annular workpiece be cooled quickly after being heated to the hardening temperature. In particular, in order to successfully harden the annular workpiece all the way to the inside, it is important to quickly cool the workpiece all the way to the inside. In this regard, with the hardening method according to the second example embodiment of the invention, the annular workpiece is able to be moved to the cooling process immediately after the heating process ends, so it is possible to quickly cool the annular workpiece all the way to the inside. Therefore, even when the annular workpiece to be hardened is a thick annular workpiece that is difficult to cool, that annular workpiece can be successfully hardened all the way to the inside.

In the aspect described above, the annular workpiece may also be made a martensitic structure with no incompletely hardened structure by the cooling process. A martensitic structure with no incompletely hardened structure is a structure in which 85 to 95% by mass is a martensitic structure, and 5 to 15% by mass is a residual austenite structure, and there is no incompletely hardened structure. Here, an incompletely hardened structure may be a bainite structure that is precipitated when the cooling rate is slow in the hardening treatment. In the martensitic structure with no incompletely hardened structure, a bainite structure is not precipitated. A hardened product formed from a martensitic structure with no incompletely hardened structure is able to be suitably used as a bearing ring or the like. Also, the cooling process that cools the annular workpiece by injecting cooling liquid is able to rapidly cool the annular workpiece that has been heated to the hardening temperature, so this cooling process is suitable as a cooling process for making the annular workpiece a martensitic structure with no incompletely hardened structure.

In the aspect described above, in the cooling process, the injection condition of the cooling liquid may be adjusted such that cooling of the small diameter portion is promoted ahead of cooling of the large diameter portion. As a result, a hardened product with even better roundness is able to be obtained. When rapidly cooling the annular workpiece to make the structure of the annular workpiece after the hardening treatment a martensitic structure with no incompletely hardened structure, the annular workpiece first contracts as the temperature drops, and then expands due to the martensitic transformation of the structure, and contracts as the temperature drops further. In this case, when the annular workpiece is cooled such that cooling of the small diameter portion is promoted ahead of cooling of the large diameter portion, the small diameter portion that was cooled ahead of the large diameter portion undergoes martensitic transformation and expands first. When this happens, the small diameter portion that expanded due to undergoing martensitic transformation, and then contracted as the temperature dropped further, comes to have a larger diameter than the large diameter portion that is in the middle of contracting. Meanwhile, the large diameter portion also starts to undergo martensitic transformation and expand, but later than the smaller diameter portion. At this time, the small diameter portion has already transformed into a martensitic structure with no incompletely hardened structure, and this martensitic structure with no incompletely hardened structure has a higher yield point than, and thus will not defolin as easily as, an austenite structure. Therefore, expansion of the large diameter portion that was cooled later is suppressed by the small diameter portion. Consequently, the amount of displacement of the large diameter portion following the expansion with martensitic transformation is less than it is with the small diameter portion that expanded ahead of the large diameter portion. As a result, the dimensional difference due to deformation (strain) according to the distribution of residual stress generated when the annular workpiece was heated to the hardening temperature is reduced when the annular workpiece is cooled, so the annular workpiece that has undergone the hardening treatment has superior roundness with little dimensional difference between the small diameter portion and the large diameter portion.

In the aspect described above, in the cooling process, the cooling liquid may be injected from an inner side and an outer side of the annular workpiece. In this case, the annular workpiece that has been heated to the hardening temperature is able to be cooled more quickly. Therefore, this method is particularly well suited as a method for cooling a thick annular workpiece.

In the aspect described above, in the cooling process, the injection condition of the cooling liquid may be adjusted by changing at least one of an injection quantity of the cooling liquid per unit time, an injection start timing of the cooling liquid, and an injection angle of the cooling liquid. These methods for adjusting the injection condition of the cooling liquid are methods suitable for adjusting both the cooling condition of the large diameter portion and the cooling condition of the small diameter portion.

In the aspect described above, the diameter of the annular workpiece may be obtained based on a measurement result by a laser displacement sensor. By obtaining the diameter of the annular workpiece by this kind of method, the diameter of the annular workpiece is able to be accurately obtained in a short period of time without contacting the annular workpiece.

According to this aspect, a hardened annular workpiece that has good roundness and little dimensional variation is able to be provided at a low cost. Also, the invention also makes it possible to respond quickly to changes in the size and the like of an annular workpiece to be hardened.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Figure 1A:
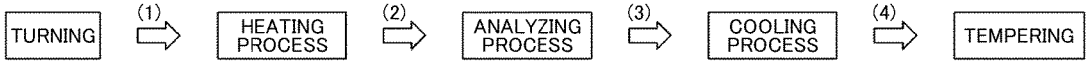
FIG. 1A is a process chart illustrating a hardening method of an annular workpiece according to a first example embodiment of the invention.
Figure 1B:
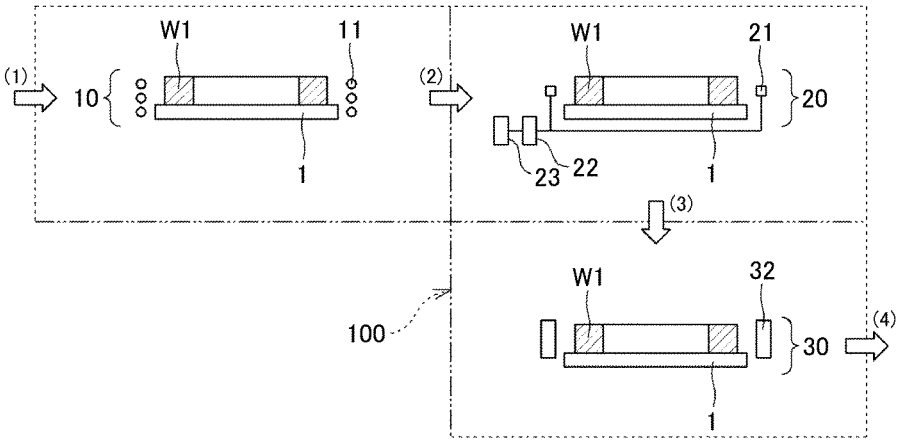
FIG. 1B is a view showing a frame format of a hardening device used with the hardening method illustrated in FIG. 1A.
Figure 2:
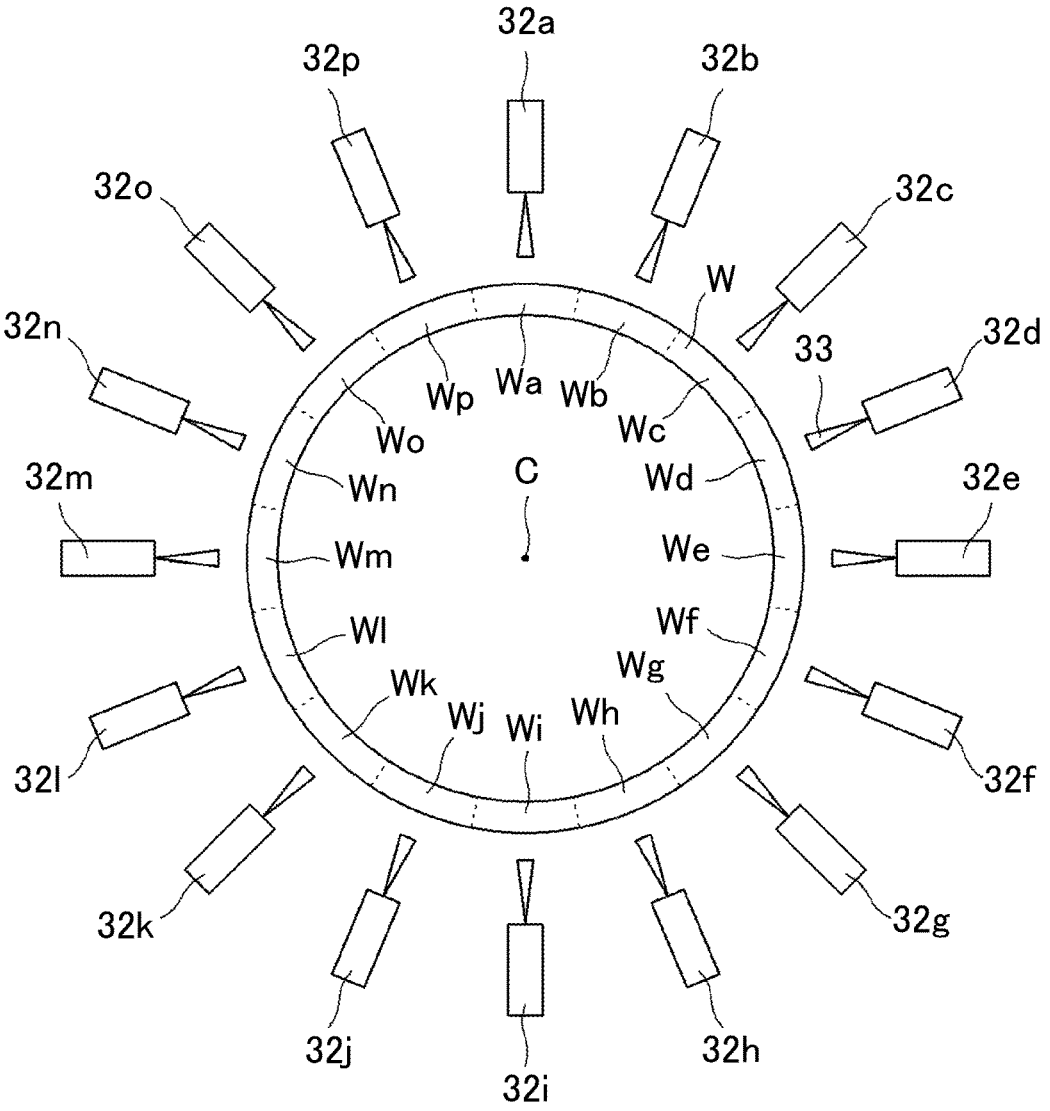
FIG. 2 is a plan view showing a frame format of a portion of a cooling system used in a cooling process of the first example embodiment.
Figure 3A:
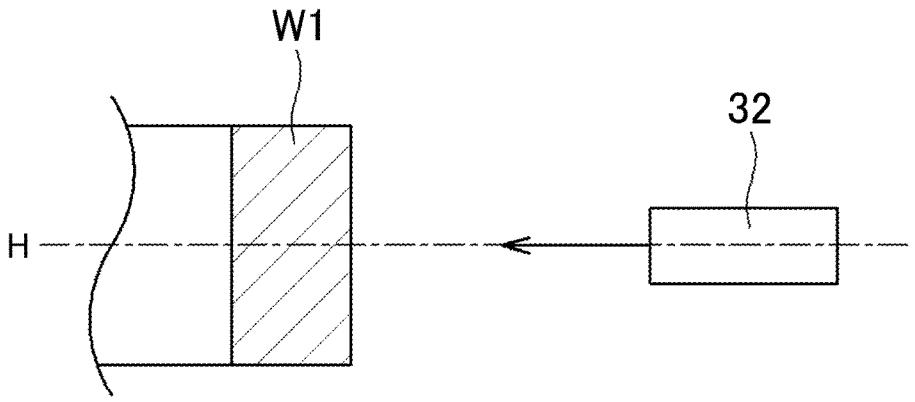
FIG. 3A is a view illustrating an injection angle of cooling liquid.
Figure 3B:
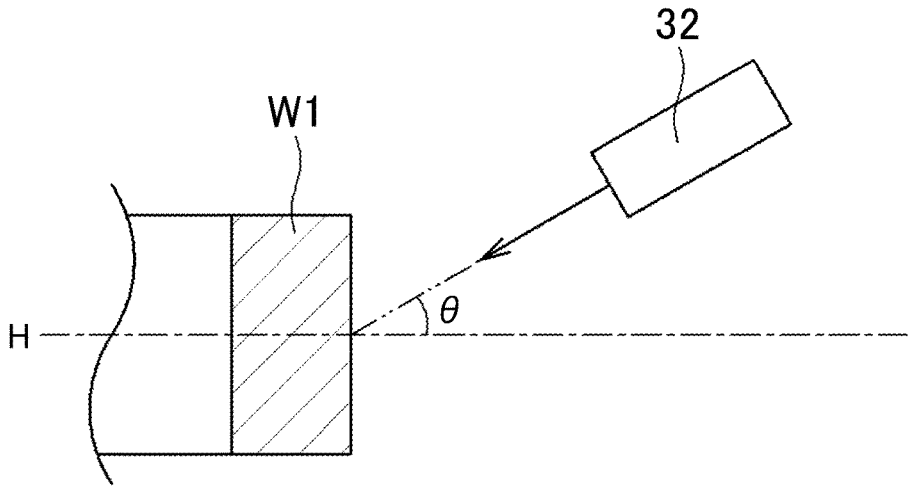
FIG. 3B is view illustrating another injection angle of cooling liquid.

Now, a first example embodiment of the invention will be described. The hardening method of this example embodiment is a method that is aimed at hardening an annular workpiece, and includes a heating process, an analyzing process, and a cooling process. The annular workpiece is made of steel. Hereinafter, the hardening method of the example embodiment will be described in the order of the processes. FIG. 1A is a process chart illustrating the hardening method of an annular workpiece according to the first example embodiment, and FIG. 1B is a view showing a frame format of a hardening device used with the hardening method illustrated in FIG. 1A. FIG. 2 is a plan view showing a frame format of a portion of a cooling system used in a cooling process of the first example embodiment. FIGS. 3A and 3B are views illustrating injection angles of cooling liquid.

The annular workpiece (hereinafter, also referred to simply as the "workpiece") to be hardened in this example embodiment is made of bearing steel. Examples of this bearing steel include, but are not limited to, high carbon-chromium bearing steel such as JIS SUJ2 and JIS SUJ3, and carburized steel (hardened steel) such as SAE 5120 and SCr420.

The size (outer diameter and thickness and the like) of the workpiece is not limited. In this example embodiment, a workpiece of an arbitrary size may be used as the object to be hardened. However, the thickness of the workpiece to be hardened in this example embodiment depends on a heating coil for induction heating. The thickness of the workpiece may be any thickness as long as the entire workpiece is able to be induction heated by the heating coil. The upper limit of the thickness of the workpiece depends on the heating coil. Also, the lower limit of the thickness of the workpiece depends on the thickness required for the annular member after heat treatment. Also, even heating of the workpiece with just the heating coil becomes more difficult the thicker the workpiece is, so if the thickness of the workpiece is equal to or greater than 10 mm, induction heating may be performed with a center core arranged in a non-contacting manner on the inner side in the radial direction of the workpiece. The center core is formed with silicon steel sheets, and has a circular cylindrical shape in one example. When the thickness of the workpiece is even in the axial direction, the thickness of the workpiece is a value that is ½of the difference between the outer diameter and the inner diameter. When the thickness of the workpiece is not even in the axial direction, the thickness of the workpiece is a value that is ½ of the difference between the outer diameter and the inner diameter at the axial position where the difference between the inner diameter and the outer diameter is greatest.

The workpiece may be manufactured by, for example, manufacturing annular material by forging from steel made of bearing steel, and forming (turning) the obtained annular material in a predetermined shape by machining or the like.

The hardening method of this example embodiment is performed using a hardening device 100 such as that shown in FIG. 1B, for example. The hardening device 100 includes an induction heating zone 10, an outer periphery analyzing zone 20, and a cooling zone 30. With this hardening method, first, a heating process is performed that heats the workpiece manufactured through turning to a hardening temperature. In this heating process, first, a workpiece W1 manufactured via turning is transported to the induction heating zone 10 that is provided with a turntable 1 and a heating coil 11, as shown in FIG. 1B (see arrow (1) in FIGS. 1A and 1B). The transported workpiece W1 is placed on the turntable 1, and set on the inner peripheral side of the heating coil 11. Then, while rotating the workpiece W1 (the turntable 1), current is made to flow through the heating coil 11, and the workpiece W1 is induction heated to a predetermined hardening temperature (for example, 900 to 1000° C. when the workpiece W1 is made of JIS SUJ2). As a result, the workpiece W1 is able to be evenly heated, so austenitizing of the workpiece W1 is able to be even performed. Here, regarding the conditions of the induction heating, the output, frequency, and heating time and the like may be adjusted so that the entire workpiece W1 from the surface to the inside is able to be heated evenly. The frequency is preferably 0.1 to 5 kHz. With the induction heating, the workpiece W1 itself is heated rapidly. The induction heating is able to shorten the time required for heating, and is thus suited to incorporating the heating process into a manufacturing line. Also, in this process, the heating temperature may be appropriately selected taking the material of the workpiece W1 and the heating method into account. Further, the heating of the workpiece W1 may be performed in an inert gas atmosphere, for example.

Next, the analyzing process that divides the heated workpiece W1 into large diameter portions and small diameter portions is performed. In this analyzing process, the heated workpiece W1 is moved to the outer periphery analyzing zone 20 provided with a laser displacement sensor (a gap sensor) (see arrow (2) in FIGS. 1A and 1B), where the radius at each position in the circumferential direction of the outer periphery of the workpiece W1 is measured, and the workpiece W1 is then divided into large diameter portions and small diameter portions based on the measurement results. The phrase "each position in the circumferential direction of the outer periphery" here refers to each position at points that are able to be measured according to the constraints of the resolution and the like of the sensor, from among the points that form the entire outer periphery.

A sensor element 21 of the laser displacement sensor is mounted in a position to the outer side of the workpiece W1, in the outer periphery analyzing zone 20. Here, the workpiece W1 is rotated to the inside of the sensor element 21 that is arranged facing the workpiece W1, by rotating the turntable 1. As a result, the distance between the sensor element 21 and each position in the circumferential direction of the outer periphery of the workpiece W1 is able to be measured.

As the laser displacement sensor, a well-known laser displacement sensor may be used, and a commercial laser displacement sensor may also be used. The color of the laser light of the laser displacement sensor is not particularly limited, but blue or green is preferable. This is because the heated workpiece W1 is red, so the distance to the workpiece W1 is able to be measured more accurately if a blue or green laser light is used.

In the analyzing process, the time required to measure the workpiece W1 is preferably as short as possible. The measuring time is preferably less than approximately three seconds. Measuring in such a short period of time is able to be achieved by using a laser displacement sensor. Keeping the measuring time to less than approximately three seconds enables a decrease in surface temperature of the workpiece W1 during measuring to be kept to 30° C. or less.

In this analyzing process, the workpiece W1 is divided into large diameter portions in which the size in the radial direction is large, and small diameter portions in which the size in the radial direction is small, as described above. This division is performed by a calculating portion 22 provided in the outer periphery analyzing zone 20. Also, the division results are stored in a storage element 23 provided in the outer periphery analyzing zone 20. Further, the roundness of the heated workpiece W1 may also be calculated in conjunction with this, as necessary.

The division of the large diameter portions and the small diameter portions described above is performed via processes (A) and (B) described below, for example. (A) is a process of measuring each position in the circumferential direction on the outer periphery of the workpiece W1 after heating, and ascertaining the outer peripheral shape of the workpiece W1 (B) is a process of dividing the workpiece W1 into large diameter portions and small diameter portions according to the outer peripheral shape of the workpiece W1.

More specifically, process (A) described above involves performing the processing in (A-1) to (A-4) described below, and ascertaining the outer peripheral shape of the workpiece W1. In (A-1), first, a virtual center C0 of the heated workpiece W1 is determined. The method for determining the virtual center C0 is not particularly limited. The virtual center C0 may be determined as appropriate. For example, a master workpiece may be placed on the turntable 1 in advance, and the center of the master workpiece may be calculated, and this center of the master workpiece may be used as the virtual center C0. In (A-2), each position in the circumferential direction of the outer periphery of the heated workpiece W1 is measured using the laser displacement sensor, and the distance between the virtual center C0 and each position in the circumferential direction of the outer periphery of the workpiece W1 is obtained. In (A-3), the distance obtained in (A-2) above is converted to XY coordinates with the virtual center C0 as the origin. In (A-4), the coordinate data obtained in (A-3) above is approximated by the method of least squares, and a circle that approximates the outer peripheral shape of the workpiece W1 (i.e., an approximate circle) is calculated. Also, the distance from a central coordinate C of the approximate circle to each of the positions in the circumferential direction of the outer periphery of the workpiece W1 is calculated, and the outer peripheral shape of the workpiece W1 is ascertained using this distance as the radius r of each of the positions in the circumferential direction of the outer periphery of the workpiece W1. The information (i.e., the central coordinate C and the radius r) about the approximate circle and the radius at each of the positions in the circumferential direction of the outer periphery of the workpiece W1 that were obtained in process (A) above are stored in the storage element 23.

Next, process (B) described above is performed. More specifically, the processing in (B-1) to (B-4) described below is performed, and the workpiece W1 is divided into the large diameter portions and the small diameter portions. In (B-1), first, a first virtual circle and a second virtual circle that are centered around the central coordinate C are obtained based on the information obtained in process (A) described above. The first virtual circle is a circle that is centered around the central coordinate C, and in which the maximum value from among the radii at the positions in the circumferential direction of the outer periphery of the workpiece W1 obtained in (A) above is taken as a radius a of the first virtual circle. Also, the second virtual circle is a circle that is centered around the central coordinate C, and in which the minimum value of the radii at the positions in the circumferential direction of the outer periphery of the workpiece W1 obtained in (A) above is taken as a radius b of the second virtual circle.

In (B-2), a reference radius c that divides the large diameter portions from the small diameter portions is calculated by the calculation formula (1) below, based on the radius a of the first virtual circle and the radius b of the second virtual circle.

$$c=(a+b)/2 \quad (1)$$

In (B-3), the workpiece W1 viewed from above is divided into 16 equal parts such that the central angles in the circumferential direction of the first virtual circle (or the second virtual circle) are equal, and is thus virtually split into 16 annular workpiece fragments W1*a* to W1*p*, separately from (B-1) and (B-2) above (see FIG. 2). Next, an average value of the radii at the positions in the circumferential direction of the outer periphery included in each annular workpiece fragment W1*a* to W1*p* is calculated for each of the annular workpiece fragments W1*a* to W1*p*.

In (B-4), the average value of the radii at the positions in the circumferential direction of each annular workpiece fragment W1*a* to W1*p* is compared to the reference radius c, and an annular workpiece fragment in which the average value is greater than the reference radius c is a large diameter portion, and an annular workpiece fragment in which the average value is equal to or less than the reference radius c is a small diameter portion.

In the analyzing process, the method for obtaining the radius at each position in the circumferential direction of the outer periphery of the workpiece W1 is not limited to a method using a laser displacement sensor. Another method may also be used. However, a method for obtaining the diameter of the workpiece W1 such as the radius at each of the positions in the circumferential direction of the outer periphery of the workpiece W1 is suited to incorporating the analyzing process into a manufacturing line.

Continuing on, the workpiece W1 is moved to the cooling zone 30 (see arrow (3) in FIGS. 1A and 1B), and a cooling process that injects cooling liquid toward the workpiece W1 is performed. In this cooling process, the heated workpiece W1 is cooled at a cooling rate that causes martensitic transformation in the workpiece W1 that has been austenitized by being heated to the hardening temperature, or more preferably, at a cooling rate that results in the workpiece W1 having a martensite structure with no incompletely hardened structure.

A cooling device that forms the cooling zone 30 is configured such that a plurality (16 in the example shown in FIG. 2) of injection nozzles 32 (32*a* to 32*p*) are positioned at equally-spaced intervals around the outer periphery of the workpiece W1, when the workpiece W1 is arranged, as shown in FIG. 2. In the cooling process, the workpiece W1 is cooled by injecting cooling liquid 33 from the outer side of the workpiece W1 using the plurality of injection nozzles 32.

In this cooling process, the cooling condition is adjusted for each portion (i.e., each annular workpiece fragment) of the workpiece W1, based on the results of dividing the workpiece W1 into large diameter portions and small diameter portions in the analyzing process described above. Here, for example, the injection condition of the cooling liquid 33 is adjusted such that cooling of the small diameter portions of the workpiece W1 is promoted ahead of cooling the large diameter portions of the workpiece W1. This adjustment of the injection condition of the cooling liquid may be performed by changing at least one of an injection quantity of the cooling liquid per unit time, an injection start timing of the cooling liquid, and an injection angle of the cooling liquid, for example.

More specifically, the injection condition of the cooling liquid may be changed in a variety of ways. For example, (a) the injection quantity of cooling liquid (the flowrate of cooling liquid) to the small diameter portions per unit time is made greater than the injection quantity of cooling liquid to the large diameter portions per unit time, (b) the injection start timing for the small diameter portions is made earlier than the injection start timing for the large diameter portions by initially injecting cooling liquid only toward the small diameter portions, and then after a set period of time has passed, injecting cooling liquid toward the entire workpiece W1 including the large diameter portions, (c) the injection angle of cooling liquid toward the workpiece W1 is made different for the small diameter portions than it is for the large diameter portions by injecting cooling liquid toward the workpiece W1 from above at an angle at the small diameter portions, and injecting cooling liquid toward the workpiece W1 from a horizontal direction (the left-right direction in FIG. 1) at the large diameter portions, (d) the injection time of the cooling liquid is made longer at the small diameter portions, and the injection time of the cooling liquid is made shorter at the large diameter portions, (e) the temperature of the cooling liquid decreased at the small diameter portions, and the temperature of the cooling liquid is increased at the large diameter portions, and (f) (a) to (e) above are combined as appropriate. As a result, cooling of the small diameter portions of the workpiece W1 is promoted ahead of cooling of the large diameter portions of the workpiece W1.

In this example embodiment of the invention, the injection angle of the cooling liquid refers to the angle formed between the injection direction of cooling liquid injected from the injection nozzles 32 toward the workpiece W1 arranged such that an outer peripheral surface (or inner peripheral surface) faces in the vertical direction, and a horizontal direction H. As shown in FIG. 3A, the injection angle of the cooling liquid is 0° when the injection direction of cooling liquid injected from the injection nozzles 32 is aligned with the horizontal direction H. Also, as shown in FIG. 3B, when the cooling liquid that is injected from the injection nozzles 32 is injected toward the workpiece W1 from above at an angle, an angle θ formed between the injection angle of the cooling liquid (see the arrow in the drawing) and the horizontal direction H is the injection angle of the cooling liquid.

In the cooling process, the cooling rate of the workpiece W1 is able to be increased when the injection angle θ is greater than 0°, compared to when the injection angle is 0° (when cooling liquid is injected from the horizontal direction). In the cooling process, typically at the beginning of cooling (at a vapor film stage), a vapor film forms on the surface of the workpiece, preventing direct contact between the coolant and the workpiece surface, and the vapor film that has low thermal conductivity impedes heat transfer, so the cooling rate is slow. When this vapor film breaks and solid-liquid contact occurs, there will be a transition to boiling (a boiling stage), and cooling of the workpiece rapidly progresses. It is thought that if the injection angle of cooling liquid is greater than 0° and cooling liquid is injected from an oblique direction (i.e., at an angle) at this time, the vapor film will break more easily, and thus the transition to the boiling stage will be earlier, which would enable the cooling rate of the workpiece to be increased. It has actually been confirmed that the cooling rate is also faster when cooling liquid is injected from above at an angle with the injection angle θ being 5° or 15° than it is when the injection angle θ is 0°. When the cooling rate of the workpiece is adjusted by adjusting the injection angle of the cooling liquid described above, the injection angle of the cooling liquid is preferably adjusted between 0° and 60°.

As already described above, even if the workpiece heated in the heating process had a shape with good roundness before heating, the workpiece may deform during the heating process and the roundness may end up deteriorating. The shape of the workpiece after the heating process may be any of various shapes, such as a generally elliptical shape or a shape having protruding portions in a plurality of locations (for example, three locations), when viewed in a plan view, and the manner of the deformation is not uniform even if the heating conditions are the same. Also, if a workpiece that has deformed in the heating process cools evenly, it is cooled while maintaining the deformed state created during heating, so the obtained hardened product will end up having poor roundness. On the other hand, in this example embodiment, the analyzing process is performed and the outer peripheral shape of the workpiece W1 is ascertained immediately after the workpiece W1 is heated to the hardening temperature, and the workpiece W1 is divided into large diameter portions and small diameter portions based on the outer peripheral shape of the workpiece W1. Then, in the cooling process, cooling conditions (the injection conditions of the cooling liquid) are adjusted so that cooling of the small diameter portions of the workpiece W1 is promoted ahead of cooling of the large diameter portions of the workpiece W1, and cooling of the workpiece W1 is performed. By cooling the workpiece W1 under this kind of condition, a displacement amount that accompanies expansion with martensitic transformation of the small diameter portions becomes greater than the displacement amount that accompanies expansion with martensitic transformation of the large diameter portions, as already described above. As a result, after the cooling process, the dimensional difference between the small diameter portions and the large diameter portions is small, so the roundness of the hardened workpiece is excellent. Also, the hardening method of this example embodiment is suited to being incorporated into a manufacturing line.

In the cooling process, the workpiece W1 is cooled by injecting cooling liquid toward the workpiece W1 using 16 injection nozzles, but the number of injection nozzles used in the cooling process is not particularly limited. The number of injection nozzles is preferably four or more.

The cooling liquid may be any liquid capable of cooling the workpiece W1. The cooling liquid is not particularly limited, and may be water, oil, or a water-soluble polymer or the like, for example. The oil may be quenching oil or the like, for example. The water-soluble polymer may be PAG (polyalkylene glycol) or the like, for example. The water-soluble polymer may be used as an aqueous solution dissolved in water. In this case, the amount of water-soluble polymer in water may be set appropriately according to the type of water-soluble polymer and the like. Only one type of these cooling liquids may be used, or two or more types of these cooling liquids may be used together.

The cooling process is preferably started as soon as possible after the workpiece is heated to the hardening temperature. If it takes time to start cooling after the workpiece is heated to the hardening temperature, it may be difficult to induce martensitic transformation in the workpiece by the cooling process. Therefore, the time to start the cooling process (the injection of the cooling liquid) is preferably as short as possible after the workpiece W1 is heated to the hardening temperature. Therefore, the cooling process is preferably started quickly after the analyzing process ends. Also, the surface temperature of the workpiece that drops before the cooling process (the injection of the cooling liquid) starts after heating to the hardening temperature is also preferably as low as possible.

In the cooling process described above, the injection time of the cooling liquid is not particularly limited, and may be set appropriately taking into account the temperature of the workpiece W1 and the flowrate of the cooling liquid and the like. Also, as indicated in the cooling liquid injection condition (b) described above, when injecting the cooling liquid with the injection start timing of cooling liquid at the large diameter portions of the workpiece W1 offset from the injection start timing of cooling liquid at the small diameter portions of the workpiece W1, the time from the start of injection toward the small diameter portions until the start of injection toward the large diameter portions is preferably no more than 10 seconds. Also, in the cooling process, the injection quantity (the flowrate) of the cooling liquid per unit time is not particularly limited, and may be set appropriately according to the size of the workpiece W1 and the number of injection nozzles and the like. The cooling zone 30 may be provided with a flowrate regulating valve or the like, not shown, to regulate the flowrate of the cooling liquid.

By performing the hardening treatment on the workpiece W1 through these kinds of processes, a hardened product of a workpiece formed by a martensitic structure with no incompletely hardened structure, which has good roundness and little dimensional variation, is able to be obtained at a low cost. Normally, tempering treatment is then applied to a workpiece that has undergone hardening treatment by the method described above (see arrow (4) in FIGS. 1A and 1B). A workpiece that has undergone hardening treatment by the hardening method of this example embodiment is able to be suitably used for a bearing ring or the like.

In the first example embodiment of invention, the method for dividing the workpiece W1 into large diameter portions and small diameter portions is not limited to the method described in the first example embodiment. For example, the radius r of the approximate circle calculated in process (A) described above may be used as a reference, and this radius r may be compared to the average value of the radii at the positions in the circumferential direction of the outer periphery of each of the annular workpiece fragments, and the workpiece may be divided into large diameter portions and small diameter portions based on this comparison.

In the analyzing process of the first example embodiment of the invention, the positions in the circumferential direction of the outer periphery of the workpiece W1 may be measured, and the inner peripheral shape of the workpiece W1 may be ascertained based on the measurement results, and then the workpiece W1 may be divided into large diameter portions and small diameter portions based on this inner peripheral shape. In this case, the division of the workpiece W1 into large diameter portions and small diameter portions may be performed by almost the same method as the method that divides the workpiece W1 into large diameter portions and small diameter portions based on the outer peripheral shape of the workpiece W1 described above. Also, the diameter of the workpiece W1 may also be obtained using technology other than a laser displacement sensor, such as thermography, for example.

With the hardening method according to the first example embodiment of the invention, the workpiece may be divided into three or more types of portions (for example, three types of portions, i.e., large diameter portions, medium diameter portions, and small diameter portions), and the cooling process may be performed adjusting the injection conditions of the cooling liquid such that cooling is promoted more the smaller the diameter of the portion is (i.e., such that cooling of smaller diameter portions is promoted ahead of cooling of larger diameter portions).

With the hardening method according to the first example embodiment of the invention, the cooling conditions may be adjusted such that cooling of the large diameter portions is promoted ahead of cooling of the small diameter portions. In this case, for example, the cooling condition of the small diameter portions and the cooling condition of the large diameter portions may be interchanged with each other in the method of (a) to (f) described above that promotes cooling of the small diameter portions ahead of cooling of the large diameter portions.

In the first example embodiment of the invention, the heating method of the workpiece is not limited to induction heating. The heating method of the workpiece may also be another well-known heating method such as furnace heating. In the first example embodiment of the invention, the material of which workpiece is made is not limited to steel for a bearing. The workpiece may also be made of steel other than steel for a bearing, and also be made of metal other than steel.

Figure 4A:
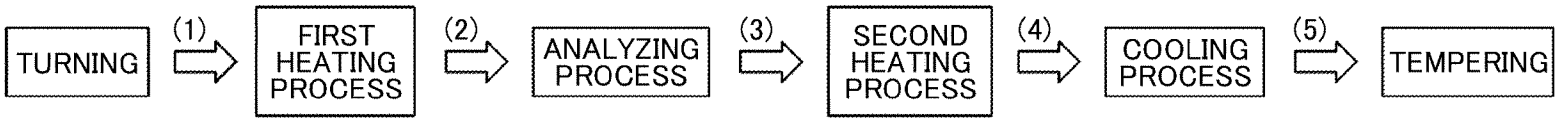
FIG. 4A is a process chart illustrating a hardening method of an annular workpiece according to a second example embodiment of the invention.
Figure 4B:
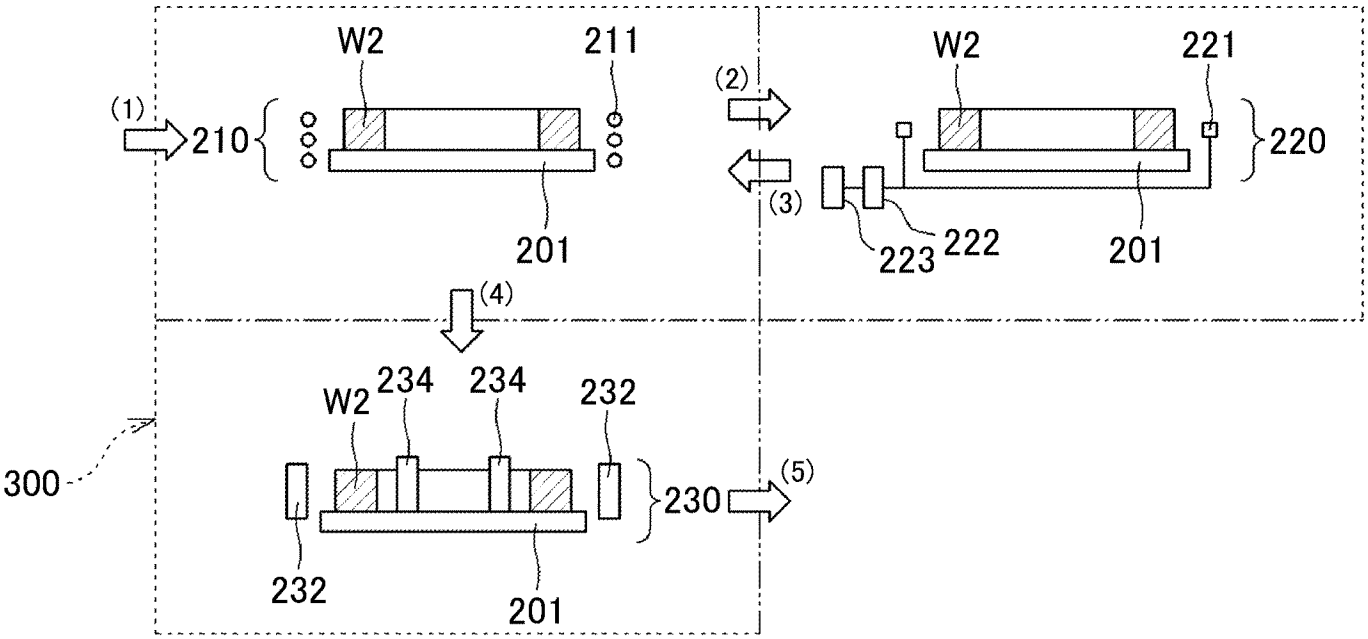
FIG. 4B is a view showing a frame format of a hardening device used with the hardening method illustrated in FIG. 4A.
Figure 5:
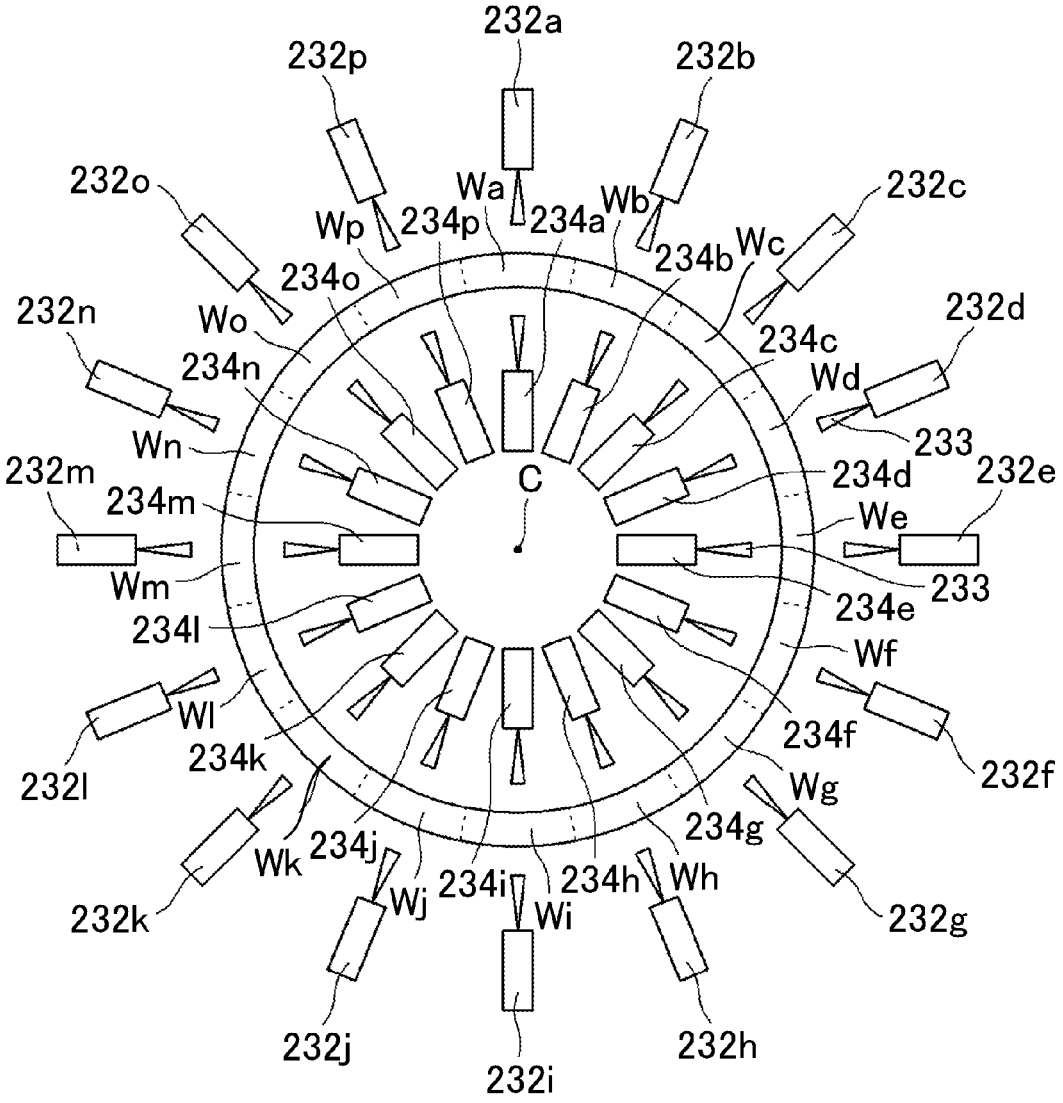
FIG. 5 is a plan view showing a frame format of a portion of a cooling system used in a cooling process of the second example embodiment.

Here, a second example embodiment of the invention will be described. The hardening method of this example embodiment is a method that is aimed at hardening an annular workpiece, and includes a first heating process, an analyzing process, a second heating process, and a cooling process. The annular workpiece is made of steel. Hereinafter, the hardening method of this example embodiment will be described in the order of the processes. FIG. 4A is a process chart illustrating the hardening method of an annular workpiece according to the second example embodiment, and FIG. 4B is a view showing a frame format of a hardening device used with the hardening method illustrated in FIG. 4A. FIG. 5 is a plan view showing a frame format of a portion of a cooling system used in a cooling process of the second example embodiment.

The annular workpiece (hereinafter, also simply referred to as the "workpiece") to be hardened in this example embodiment is made of bearing steel, similar to the first example embodiment. In this example embodiment as well, the size of the workpiece is not particularly limited. In this example embodiment, a workpiece of an arbitrary size may be used as the object to be hardened. Meanwhile, the thickness of the workpiece to be hardened in this example embodiment depends on a heating coil for induction heating. The thickness of the workpiece may be any thickness as long as the entire workpiece is able to be induction heated by the heating coil. The upper limit of the thickness of the workpiece depends on the heating coil. Also, the lower limit of the thickness of the workpiece depends on the thickness required for the annular member after heat treatment. Also, even heating of the workpiece with just the heating coil becomes more difficult the thicker the workpiece is, so if the thickness of the workpiece is equal to or greater than 10 mm, induction heating may be performed with a center core arranged in a non-contacting manner on the inner side in the radial direction of the workpiece. The center core is formed with silicon steel sheets, and has a circular cylindrical shape in one example.

In this example embodiment, similar to the first example embodiment, hardening treatment is applied to the workpiece made of bearing steel manufactured via turning or the like. The hardening method of this example embodiment is performed using a hardening device 300, for example. The hardening device 300 includes an induction heating zone 210, an outer periphery analyzing zone 220, and a cooling zone 230. With this hardening method, first, a first heating process is performed that heats the workpiece manufactured via turning to a temperature at which stress is released (a stress release temperature).

In this first heating process, first, a workpiece W2 manufactured via turning is transported to the induction heating zone 210 provided with a turntable 201 and a heating coil 211, as shown in FIG. 4B (see arrow (1) in FIG. 4B). The transported workpiece W2 is placed on the turntable 201, and set on an inner peripheral side of the heating coil 211. Then, while rotating the workpiece W2 (the turntable 201), current is made to flow through the heating coil 211, and the workpiece W2 is induction heated to a temperature at which residual stress in the workpiece W2 is released. At this time, regarding the conditions of the induction heating, the output, frequency, and heating time and the like are adjusted so that the entire workpiece W2 from the surface to the inside is able to be heated evenly. The frequency is preferably 0.1 to 5 kHz. The heating temperature in the first heating process is also lower than the hardening temperature. This is because heating to the hardening temperature is performed in the second heating process later on. As a result, residual stress in the workpiece W2 that was generated when manufacturing the workpiece W2 is released, and deformation according to the residual stress occurs in the heated workpiece W2. Deformation according to the residual stress occurring here remains almost as it is when the workpiece is heated to the hardening temperature.

The heating temperature of the workpiece W2 in the first heating process is preferably a temperature between 500 and 700° C. This is because with the workpiece W2 heated to a temperature in this range, the residual stress is substantially released, so there is no more random deformation due to residual stress. On the other hand, if the heating temperature of the workpiece W2 is lower than 500° C., the residual stress in the workpiece W2 will not be sufficiently released, and if the heating temperature is above 700° C., phase transformation will start to occur in the structure of the workpiece W2, so it is not suitable for interrupting heating. A more preferable heating temperature is a temperature between 500 and 650° C., and an even more preferable heating temperature is 600 to 650° C.

Next, the heated workpiece W2 is moved to the outer periphery analyzing zone 220 provided with a laser displacement sensor (a gap sensor) (see arrow (2) in FIG. 4B), and an analyzing process is performed that ascertains the outer diameter shape of the workpiece W2, and divides the workpiece W2 into large diameter portions and small diameter portions. In this analyzing process, a method similar to that used in the first example embodiment may be used as the method for dividing the workpiece W2 into large diameter portions and small diameter portions.

Then, the workpiece W2 that has finished the analyzing process is transported to the induction heating zone 210 again (see arrow (3) in FIG. 4B), and the second heating process is performed that induction heats the workpiece W2 to a predetermined hardening temperature (for example, 900 to 1000° C. when the workpiece W2 is made of JIS SUJ2). In this second heating process, similar to the first heating process, while rotating the workpiece W2 that has been placed on the turntable 201 and set on the inner peripheral side of the heating coil 211, current is made to flow through the heating coil 211, and the workpiece W2 is induction heated. At this time, the frequency as the heating condition is preferably 0.1 to 5 kHz. In this process, the workpiece W2 is able to be heated evenly, so austenitizing of the workpiece W2 is able to be evenly performed. Also, in this process, the workpiece W2 is heated to the hardening temperature while deformation according to the residual stress generated in the first heating process remains. In the second heating process, the hardening temperature of the workpiece W2 may be appropriately selected taking into account the material of the workpiece W2 and the heating method. Further, the heating of the workpiece W2 may be performed in an inert gas atmosphere, for example.

Continuing on, the workpiece W2 that has been heated to the hardening temperature is moved to the cooling zone 230 (see arrow (4) in FIG. 4B), and a cooling process that injects cooling liquid toward the workpiece W2 is performed. In this cooling process, the heated workpiece W2 is cooled at a cooling rate that causes martensitic transformation in the workpiece W2 that has been austenitized, or more preferably, at a cooling rate that results in the workpiece W2 having a martensite structure with no incompletely hardened structure.

The cooling zone 230 is configured to inject cooling liquid toward the workpiece W2 from both the inner side and the outer side of the workpiece W2. A cooling device that forms the cooling zone 230 is configured such that a plurality (16 in the example shown in FIG. 5) of injection nozzles 232 (232*a* to 232*p*) are positioned at equally-spaced intervals around the outer periphery of the workpiece W2, and a plurality (16 in the example shown in FIG. 5) of injection nozzles 234 (234*a* to 234*p*) are positioned at equally-spaced intervals around the inner periphery of the workpiece W2, when the workpiece W2 is arranged, as shown in FIG. 5. In the cooling zone 230, the workpiece W2 is cooled by injecting cooling liquid 233 toward the workpiece W2 via the injection nozzles 232*a* to 232*p* and 234*a* to 234*p*.

In this cooling process, the cooling condition is adjusted for each portion of the workpiece W2 (i.e., each annular workpiece fragment), based on the results of dividing the workpiece W2 into large diameter portions and small diameter portions in the analyzing process described above. Here, for example, the injection condition of the cooling liquid 233 is adjusted such that cooling of the small diameter portions of the workpiece W2 is promoted ahead of cooling the large diameter portions of the workpiece W2. The same method used in the first example embodiment may be used as the specific method for adjusting the injection condition.

With this kind of hardening method of this example embodiment, similar to the hardening method of the first example embodiment, in the cooling process, the workpiece is cooled such that deformation (strain) according to the distribution of residual stress generated when the workpiece was heated is released, so a hardened product having good roundness is able to be obtained. Furthermore, the hardening method of this example embodiment is also suited to being incorporated in a manufacturing line.

Moreover, with the hardening method of this example embodiment, after the first heating process that heats the workpiece to a temperature at which residual stress is released is performed, the analyzing process is performed, and then after the second heating process that heats the workpiece to the hardening temperature is performed, the cooling process is performed. Therefore, unlike the first example embodiment, it is possible to transition to the cooling process immediately after the workpiece W2 is heated to the hardening temperature. Also, in the cooling process, the workpiece W2 is cooled by injecting cooling liquid not only from the outer side of the heated workpiece W2, but also from the inner side of the heated workpiece W2. Therefore, in this example embodiment, after the heating process ends, the workpiece W2 is able to be cooled all the way to the inside in a shorter period of time. Accordingly, in this example embodiment, even if the workpiece to be hardened is a thick workpiece, a hardened product having good roundness that has been sufficiently hardened all the way to the inside is able to be obtained. Naturally, the example embodiment is also suited to hardening treatment in which a thin workpiece is to be treated.

In this example embodiment, the number of injection nozzles used in the cooling process is not particularly limited. The number of injection nozzles is preferably equal to or greater than four both around the outer periphery and around the inner periphery. Also, the same cooling liquid used in the first example embodiment may be used as the cooling liquid described above In the cooling process described above, the injection time of the cooling liquid is not particularly limited, and may be set appropriately taking into account the temperature of the workpiece W2 and the flowrate of the cooling liquid. Also, in the cooling process described above, when the injection of cooling liquid is performed with the injection start timing of cooling liquid at the large diameter portions of the workpiece W2 offset from the injection start timing of cooling liquid at the small diameter portions of the workpiece W2, the time from the start of injection toward the small diameter portions until the start of injection toward the large diameter portions is preferably no more than 10 seconds. Also, in the cooling process, the injection quantity (the flowrate) of the cooling liquid per unit time is not particularly limited, and may be set appropriately according to the size of the workpiece W2 and the number of injection nozzles and the like. Also, in the cooling process, when the injection angle of the cooling liquid is offset, the injection angle is not particularly limited, and may be set appropriately according to the size of the workpiece W2 and the number of injection nozzles and the like. At this time, the injection angle of the cooling liquid is preferably adjusted between 0° and 60°. Also, the injection conditions of the injection nozzles 232 on the outer side and the injection nozzles 234 on the inner side that face each other with the workpiece W2 sandwiched in between may be the same or they may be different from each other.

By performing the hardening treatment on the workpiece W2 through these kinds of processes, a hardened product of a workpiece formed by martensite, which has good roundness and little dimensional variation, is able to be obtained at a low cost. Normally, tempering treatment is then applied to a workpiece that has undergone hardening treatment by the method described above (see arrow (5) in FIG. 4A). A workpiece that has undergone hardening treatment by the hardening method of this example embodiment is able to be suitably used for a bearing ring or the like.

With the hardening method according to the second example embodiment, as the method for dividing the workpiece W2 into large diameter portions and small diameter portions, a method that uses the radius r of the approximate circle calculated in process (A) described above as a reference, and compares this radius r to the average value of the radii at the positions in the circumferential direction of the outer periphery of each of the annular workpiece fragments, and divides the workpiece into large diameter portions and small diameter portions based on this comparison may also be used.

In the analyzing process of the second example embodiment of the invention, the positions in the circumferential direction of the outer periphery of the workpiece W2 may be measured, and the inner peripheral shape of the workpiece W2 may be ascertained based on the measurement results, and then the workpiece W2 may be divided into large diameter portions and small diameter portions based on the inner peripheral shape. In this case, the division of the workpiece W2 into large diameter portions and small diameter portions may be performed by almost the same method as the method that divides the workpiece W2 into large diameter portions and small diameter portions based on the outer peripheral shape of the workpiece W2 described above. Also, the diameter of the workpiece W2 may also be obtained using technology other than a laser displacement sensor, such as thermography, for example.

With the hardening method according to the second example embodiment of the invention, the workpiece may be divided into three or more types of portions (for example, three types of portions, i.e., large diameter portions, medium diameter portions, and small diameter portions), and the cooling process may be performed using three or more types of cooling conditions such that cooling is promoted more the smaller the diameter of the portion is (i.e., such that cooling of smaller diameter portions is promoted ahead of cooling of larger diameter portions).

In the second example embodiment of the invention, the heating method of the workpiece is not limited to induction heating. The heating method of the workpiece may also be another well-known heating method such as furnace heating. In the second example embodiment of the invention, the material of which workpiece is made is not limited to steel for a bearing. The workpiece may also be made of steel other than steel for a bearing, and also be made of metal other than steel.

With the hardening method according to the second example embodiment of the invention, the cooling conditions may be adjusted such that cooling of the large diameter portions is promoted ahead of cooling of small diameter portions. In this case, for example, the cooling condition of the small diameter portions and the cooling condition of the large diameter portions may be interchanged with each other in the method of (a) to (f) described above that promotes cooling of small diameter portions ahead of cooling of large diameter portions.

The operation and effects of the hardening method according to the first example embodiment were verified. Here, annular workpieces described below were used as test pieces, and tests were performed with Examples 1 to 5 and Comparative examples 1 to 4. (Preparation of test pieces for evaluation) Annular material made of JIS SUJ2 steel was manufactured, and the obtained annular material was cut and machined in a predetermined shape to obtain annular workpieces (each having an outer diameter of 125 mm and a thickness of 4 mm)

In Example 1first the roundness of an annular workpiece (test piece) before heating was calculated. The roundness was 80 μm. The roundness was calculated using a laser displacement sensor (made by Keyence Corporation), and the difference between the radius of the first virtual circle and the radius of the second virtual circle calculated by the method described above was used as the roundness.

Next, the annular workpiece was introduced to the induction heating zone 10 of the hardening device 100 (see FIG. 1B) that includes the induction heating zone 10, the outer periphery analyzing zone 20, and the cooling zone 30, and the entire annular workpiece was induction heated to 950° C. by induction heating. Here, the heating condition was a frequency of 1 kHz and a heating time of 30 seconds. Also, the temperature of the annular workpiece was measured by the surface temperature using a thermocouple. The shape of the annular workpiece after heating was generally elliptical when viewed in a plan view.

Continuing on, the heated annular workpiece was moved to the outer periphery analyzing zone 20, where it was divided into large diameter portions and small diameter portions, and information regarding this division was then stored in the storage element 23. Here, the method via processes (A) and (B) described above were employed as the method for dividing the annular workpiece into large diameter portions and small diameter portions. That is, first, the outer peripheral shape of the annular workpiece was ascertained via process (A) described above. Then, each of the 16 annular workpiece fragments into which the workpiece was virtually divided was classified as either a large diameter portion or a small diameter portion, based on the reference radius c obtained from the first virtual circle and the second virtual circle of the annular workpiece described above, by performing process (B) described above.

Next, the annular workpiece was moved to the cooling zone 30, and cooling treatment that injects cooling liquid at a predetermined condition toward the annular workpiece was performed. Here, the annular workpiece is arranged to the inside of the injection nozzles 32, in the cooling zone 30 that includes the 16 injection nozzles 32 (32*a* to 32*p*) for injecting cooling liquid that are arranged at equally-spaced intervals as shown in FIG. 2, and cooling treatment that injects the cooling liquid 33 at the outer peripheral side of the annular workpiece was performed.

The conditions described below were employed as the injection conditions of the cooling liquid. At the small diameter portions, cooling liquid started to be injected at a flowrate of 1.8 L/min per one injection nozzle one second after the end of the analyzing process, and the cooling liquid was injected for 30 seconds. The injection angle of the cooling liquid was 0°. At the large diameter portions, cooling liquid started to be injected at a flowrate of 1.2 L/min per one injection nozzle one second after the end of the analyzing process, and the cooling liquid was injected for 30 seconds. The injection angle of the cooling liquid was 0°. As a result of this kind of hardening treatment, the internal structure of the annular workpiece became a martensitic structure with no incompletely hardened structure. Also, upon calculating the roundness of the annular workpiece after the hardening treatment, it was 65 μm.

With Example 2, hardening treatment was applied to an annular workpiece just as in Example 1, except that the cooling condition (the injection condition of the cooling liquid) was changed as described below. At the small diameter portions, cooling liquid started to be injected at a flowrate of 1.8 L/min per one injection nozzle one second after the end of the analyzing process, and the cooling liquid was injected for 30 seconds. The injection angle of the cooling liquid was 0°. At the large diameter portions, cooling liquid started to be injected at a flowrate of 1.5 L/min per one injection nozzle one second after the end of the analyzing process, and the cooling liquid was injected for 30 seconds. The injection angle of the cooling liquid was 0°.

In this example, the roundness before heating the annular workpiece was 60 μm, and the roundness after cooling was 60 μm. The shape of the annular workpiece after heating was a shape having protruding portions in three locations when viewed in a plan view.

With Example 3, hardening treatment was applied to an annular workpiece just as in Example 1, except that the cooling condition (the injection condition of the cooling liquid) was changed as described below. At the small diameter portions, cooling liquid started to be injected at a flowrate of 1.8 L/min per one injection nozzle one second after the end of the analyzing process, and the cooling liquid was injected for 30 seconds. The injection angle of the cooling liquid was 0°. At the large diameter portions, cooling liquid started to be injected at a flowrate of 1.8 L/min per one injection nozzle six seconds after the end of the analyzing process, and the cooling liquid was injected for 30 seconds. The injection angle of the cooling liquid was 0°.

In this example, the roundness before heating the annular workpiece was 92 μm, and the roundness after cooling was 65 μm. The shape of the annular workpiece after heating was a generally elliptical shape when viewed in a plan view.

With Example 4, hardening treatment was applied to an annular workpiece just as in Example 1, except that the cooling condition (the injection condition of the cooling liquid) was changed as described below. At the small diameter portions, cooling liquid started to be injected at a flowrate of 1.8 L/min per one injection nozzle one second after the end of the analyzing process, and the cooling liquid was injected for 30 seconds. The injection angle of the cooling liquid was 0°. At the large diameter portions, cooling liquid started to be injected at a flowrate of 1.8 L/min per one injection nozzle three seconds after the end of the analyzing process, and the cooling liquid was injected for 30 seconds. The injection angle of the cooling liquid was 0°.

In this example, the roundness before heating the annular workpiece was 65 μm, and the roundness after cooling was 65 μm. The shape of the annular workpiece after heating was a shape having protruding portions in three locations when viewed in a plan view.

With Example 5, hardening treatment was applied to an annular workpiece just as in Example 1, except that the cooling condition (the injection condition of the cooling liquid) was changed as described below. At the small diameter portions, cooling liquid started to be injected at a flowrate of 1.6 L/min per one injection nozzle one second after the end of the analyzing process, and the cooling liquid was injected for 30 seconds. The injection angle of the cooling liquid was 15°. At the large diameter portions, cooling liquid started to be injected at a flowrate of 1.2 L/min per one injection nozzle one second after the end of the analyzing process, and the cooling liquid was injected for 30 seconds. The injection angle of the cooling liquid was 0°.

In this example, the roundness before heating the annular workpiece was 85 μm, and the roundness after cooling was 75 μm. The shape of the annular workpiece after heating was a generally elliptical shape when viewed in a plan view.

With Comparative example 1, first, the roundness of an annular workpiece (a test piece) before heating was calculated. The roundness was 78 μm. Next, the annular workpiece was put into a heating furnace, and furnace heated for 0.5 hours at 830° C.

Next, cooling treatment by oil cooling in which the annular workpiece is put into 80° C. cooling oil was performed. As a result of this kind of treatment, the internal structure of the annular workpiece became a martensitic structure with no incompletely hardened structure. Also, the roundness of the annular workpiece after the hardening treatment was 500 μm.

With Comparative example 2, first, the roundness of an annular workpiece (a test piece) before heating was calculated. The roundness was 62 μm. Next, the annular workpiece was put into a heating furnace, and furnace heated for 0.5 hours at 830° C.

Next, cooling treatment by oil cooling in which the annular workpiece is put into 80° C. cooling oil was performed. Then a correction was performed on the annular workpiece. The roundness of the annular workpiece after the correction was 100 μm. Also, as a result of this kind of hardening treatment, the internal structure of the annular workpiece became a martensitic structure with no incompletely hardened structure.

With Comparative example 3, hardening treatment was applied to an annular workpiece just as in Example 1, except that the cooling condition (the injection condition of the cooling liquid) was changed as described below. All of the injection nozzles were opened one second after the end of the analyzing process, and cooling liquid started to be injected toward the entire annular workpiece at a flowrate of 0.5 L/min per one injection nozzle, and the cooling liquid was injected for 30 seconds. The injection angle of the cooling liquid was 0°.

In this comparative example, the roundness of the annular workpiece before heating was 73 μm, and the roundness after cooling was 200 μm.

With Comparative example 4, hardening treatment was applied to an annular workpiece just as in Comparative example 3, except that the annular workpiece was induction heated, while the inner peripheral surface and the outer peripheral surface of the annular workpiece were each restrained by a restraining device in the heating process. In this comparative example, the roundness before heating of the annular workpiece was 70 μm, and the roundness after cooling was 50 μm.

Table 1 shows the results of verification of Examples 1 to 5 and Comparative examples 1 to 4.

TABLE 1

| | Steel | | Roundness | | | Cooling condition *1 | | |
|---|---|---|---|---|---|---|---|---|
| | grade of test piece | Thickness (mm) | before heating (μm) | Heating condition | Restraining device | Cooling start timing (sec) *2 | Flowrate (L/min) *3 | Injection angle (°) |
| Example 1 | SUJ2 | 4 | 80 | Induction heating 950° C.-30 sec | Without | 1 | 1.8 | 0 |
| | | | | | | 1 | 1.2 | 0 |
| Example 2 | ↑ | 4 | 60 | ↑ | Without | 1 | 1.8 | 0 |
| | | | | | | 1 | 1.5 | 0 |
| Example 3 | ↑ | 4 | 92 | ↑ | Without | 1 | 1.8 | 0 |
| | | | | | | 6 | 1.8 | 0 |

TABLE 1-continued

| | | | | | | | | |
|---|---|---|---|---|---|---|---|---|
| Example 4 | ↑ | 4 | 65 | ↑ | Without | 1<br>3 | 1.8<br>1.8 | 0<br>0 |
| Example 5 | ↑ | 4 | 85 | ↑ | Without | 1<br>1 | 1.6<br>1.2 | 15<br>0 |
| Comparative example 1 | ↑ | 4 | 78 | Furnace heating 830° C.-0.5 h | Without | — | —<br>(Put into cooling oil) | — |
| Comparative example 2 | ↑ | 4 | 62 | ↑ | Without | — | ↑ | — |
| Comparative example 3 | ↑ | 4 | 73 | Induction heating 950° C.-30 sec | Without | 1 | 0.5 | 0 |
| Comparative example 4 | ↑ | 4 | 70 | ↑ | With | 1 | 0.5 | 0 |

| | Internal structure after hardening treatment | Correction | Roundness after hardening treatment (μm) | Roundness after hardening with respect to roundness before heating (after hardening/before heating) |
|---|---|---|---|---|
| Example 1 | Martensitic structure with no incompletely hardened structure | No | 65 | 0.8 |
| Example 2 | Martensitic structure with no incompletely hardened structure | No | 60 | 1.0 |
| Example 3 | Martensitic structure with no incompletely hardened structure | No | 65 | 0.7 |
| Example 4 | Martensitic structure with no incompletely hardened structure | No | 65 | 1.0 |
| Example 5 | Martensitic structure with no incompletely hardened structure | No | 75 | 0.9 |
| Comparative example 1 | Martensitic structure with no incompletely hardened structure | No | 500 | 6.4 |
| Comparative example 2 | Martensitic structure with no incompletely hardened structure | Yes | 100 | 1.6 |
| comparative example 3 | Martensitic structure with no incompletely hardened structure | No | 200 | 2.7 |
| Comparative example 4 | Martensitic structure with no incompletely hardened structure | No | 50 | 0.7 |

*1: In cooling conditions in Examples 1 to 5, the cooling condition of the small diameter portion is shown above, and the cooling condition of the large diameter portion is shown below.
*2: The cooling start timing of the cooling conditions in Examples 1 to 5 and Comparative examples 3 and 4 is indicated by the time after the analyzing process ends until the cooling liquid starts to be injected.
*3: The flowrate in the cooling conditions in Examples 1 to 5 and Comparative examples 3 and 4 indicates the flowrate per one injection nozzle.

As shown in Table 1, with the hardening method of the first example embodiment of the invention, it is evident that a hardened product with good roundness can be obtained even if a restraining device is not used at the time of heating, or even if a correction is not applied after cooling. Therefore, according to the hardening method according to the first example embodiment of the invention, a hardened product with good roundness can be provided at a low cost. Also, a restraining device does not have to be used, so it is also possible to respond quickly to changes in the size and the like of an annular workpiece.

The operation and effects of the hardening method according to the second example embodiment were verified. Here, annular workpieces described below were used as test pieces, and tests were performed with Examples 6 to 8, Reference examples 1 and 2, and Comparative examples 5 and 6. (Preparation of test pieces for evaluation) Annular material made of JIS SUJ2 steel was manufactured, and the obtained annular material was cut and machined in a predetermined shape to obtain annular workpieces (each having an outer diameter of 200 mm and a thickness of 10 to 20 mm).

With Example 6, the roundness of an annular workpiece (a test piece having a thickness of 15 mm) before heating was calculated. The roundness was 100 μm. The roundness was calculated by the same method used in Example 1. Next, the annular workpiece was transported to the induction heating zone 210 of the hardening device 300 (see FIG. 4B) that includes the induction heating zone 210, the outer periphery analyzing zone 220, and the cooling zone 230, and the entire annular workpiece was induction heated to 600° C. Here, the heating condition was a frequency of 1 kHz. Also, the temperature of the annular workpiece was measured by the surface temperature using a thermocouple. At this time, the shape of the heated annular workpiece was generally elliptical when viewed in a plan view.

Continuing on, the heated annular workpiece was moved to the outer periphery analyzing zone 220, where it was divided into large diameter portions and small diameter portions, and information regarding this division was then stored in the storage element 223. Here, the same method employed with Example 1 was employed as the method to divide the annular workpiece into large diameter portions and small diameter portions.

Next, the annular workpiece was again transported to the induction heating zone 210 and the entire annular workpiece was heated to 950° C. under the same condition as the that of the heating described above. The total time required to heat the annular workpiece to 600° C. in the heating process, divide the annular workpiece in the analyzing process, and heat the annular workpiece to the hardening temperature (950° C.) in this process was 70 seconds. Also, in this example, the time required to transport the annular workpiece that was heated to 600° C. to the induction heating zone 210 again after transporting it to the outer periphery analyzing zone 220 and dividing it into large diameter portions and small diameter portions was 10 seconds.

After being heated to the hardening temperature, the annular workpiece was immediately moved to the cooling zone 230, and the cooling treatment that injects cooling liquid under a predetermined condition toward the annular workpiece was performed. Here, the annular workpiece was arranged between the injection nozzles 232 and the injection nozzles 234, in the cooling zone 230 having the cooling system in which the 16 injection nozzles 232 (232*a* to 232*p*) for injecting cooling liquid are arranged at equally-spaced intervals around the outer periphery of the annular workpiece, and the 16 injection nozzles 234 (234*a* to 234*p*) for injecting cooling liquid are arranged at equally-spaced intervals around the inner periphery of the annular workpiece, as shown in FIG. 5, and cooling treatment was performed.

The conditions described below were employed as the injection conditions of the cooling liquid. At the small diameter portions, cooling liquid started to be injected at a flowrate of 2.0 L/min per one injection nozzle, from both the injection nozzles on the inner side and the injection nozzles on the outer side, one second after the end of heating to the hardening temperature (950° C.), and the cooling liquid was injected for 60 seconds. The injection angle of the cooling liquid was 0°. At the large diameter portions, cooling liquid started to be injected at a flowrate of 1.8 L/min per one injection nozzle, from both the injection nozzles on the inner side and the injection nozzles on the outer side, one second after the end of heating to the hardening temperature (950° C.), and the cooling liquid was injected for 60 seconds. The injection angle of the cooling liquid was 0°. As a result of this kind of hardening treatment, the internal structure of the annular workpiece became a martensitic structure with no incompletely hardened structure. Also, the roundness of the annular workpiece after the hardening treatment was 120 μm.

With Example 7, an annular workpiece having a thickness of 20 mm was used as the annular workpiece (the test piece), and hardening treatment was applied to the annular workpiece just as in Example 6, except that the heating condition and the cooling condition (the injection condition of the cooling liquid) were changed as described below.

The roundness of the annular workpiece before heating was 150 μm. The annular workpiece was induction heated at a frequency of 1 kHz. At the small diameter portions, cooling liquid started to be injected at a flowrate of 2.2 L/min per one injection nozzle, from both the injection nozzles on the inner side and the injection nozzles on the outer side, one second after the end of heating to the hardening temperature (950° C.), and the cooling liquid was injected for 60 seconds. The injection angle of the cooling liquid was 0°. At the large diameter portions, cooling liquid started to be injected at a flowrate of 1.8 L/min per one injection nozzle, from both the injection nozzles on the inner side and the injection nozzles on the outer side, one second after the end of heating to the hardening temperature (950° C.), and the cooling liquid was injected for 60 seconds. The injection angle of the cooling liquid was 0°.

In this example, as a result of this hardening treatment, the internal structure of the annular workpiece became completely martensitic. Also, the roundness of the annular workpiece after the hardening treatment was 130 μm. Also, the shape of the annular workpiece when heated to 600° C. was generally elliptical when viewed in a plan view.

In Example 8, first, the roundness of an annular workpiece (a test piece having a thickness of 10 mm) before heating was calculated. The roundness was 120 μm. Next, the annular workpiece was transported to the induction heating zone 210 of the hardening device 300 (see FIG. 4B) having the induction heating zone 210, the outer periphery analyzing zone 220, and the cooling zone 230, and the entire annular workpiece was heated to 600° C. Here, the heating condition was a frequency of 1 kHz. Also, the temperature of the annular workpiece was measured just as it was in Example 6. At this time, the shape of the heated annular workpiece was generally elliptical when viewed in a plan view.

Continuing on, the heated annular workpiece was moved to the outer periphery analyzing zone 220, where it was divided into large diameter portions and small diameter portions, and information regarding this division was then stored in the storage element 223. Here, the same method employed with Example 1 was employed as the method to divide the annular workpiece into large diameter portions and small diameter portions.

Next, the annular workpiece was again transported to the induction heating zone 210, and the annular workpiece was heated to 950° C. The total time required to heat the annular workpiece to 600° C. in the heating process, divide the annular workpiece in the analyzing process, and heat the annular workpiece to the hardening temperature (950° C.) in this process was 40 seconds. Also, in this example, the time required to transport the annular workpiece that was heated to 600° C. to the induction heating zone 210 again after transporting it to the outer periphery analyzing zone and dividing it into large diameter portions and small diameter portions was 10 seconds.

After being heated to the hardening temperature, the annular workpiece was immediately moved to the cooling zone 230, and the annular workpiece was cooled just as in Example 6, except that the cooling condition (the injection condition of the cooling liquid) was changed as described below. At the small diameter portions, cooling liquid started to be injected at a flowrate of 1.8 L/min per one injection nozzle, from both the injection nozzles on the inner side and the injection nozzles on the outer side, one second after the end of heating to the hardening temperature (950° C.), and the cooling liquid was injected for 60 seconds. The injection angle of the cooling liquid was 0°. At the large diameter portions, cooling liquid started to be injected at a flowrate of 1.5 L/min per one injection nozzle, from both the injection nozzles on the inner side and the injection nozzles on the outer side, one second after the end of heating to the hardening temperature (950° C.), and the cooling liquid was injected for 60 seconds. The injection angle of the cooling liquid was 0°. As a result of this kind of hardening treatment, the internal structure of the annular workpiece became a martensitic structure with no incompletely hardened structure. Also, the roundness of the annular workpiece after the hardening treatment was 100 μm.

With Reference example 1, first, the roundness of an annular workpiece (a test piece having a thickness of 20 mm) before heating was calculated. The roundness was 150

μm. Next, the annular workpiece was transported to the induction heating zone 210 of the hardening device 300 (see FIG. 4B) having the induction heating zone 210, the outer periphery analyzing zone 220, and the cooling zone 230, and the entire annular workpiece was heated to 950° C. Here, the heating condition was a frequency of 1 kHz and a heating time of 60 seconds. The temperature of the annular workpiece was measured just as it was in Example 6. At this time, the shape of the heated annular workpiece was generally elliptical when viewed in a plan view. Then, the annular workpiece was cooled to 750° C. by air cooling.

Continuing on, the annular workpiece that had been cooled to 750° C. after being heated to the hardening temperature was moved to the outer periphery analyzing zone 220, where it was divided into large diameter portions and small diameter portions, and information regarding this division was then stored in the storage element 223. Here, the same method employed with Example 1 was employed as the method to divide the annular workpiece into large diameter portions and small diameter portions.

Next, the annular workpiece was moved to the cooling zone 230, and the annular workpiece was cooled just as in Example 6, except that the cooling condition (the injection condition of the cooling liquid) was changed as described below. At the small diameter portions, cooling liquid started to be injected at a flowrate of 2.0 L/min per one injection nozzle, from both the injection nozzles on the inner side and the injection nozzles on the outer side, one second after the temperature of the annular workpiece reached 750° C. by air cooling, and the cooling liquid was injected for 60 seconds. The injection angle of the cooling liquid was 0°. At the large diameter portions, cooling liquid started to be injected at a flowrate of 1.5 L/min per one injection nozzle, from both the injection nozzles on the inner side and the injection nozzles on the outer side, one second after the temperature of the annular workpiece reached 750° C. by air cooling, and the cooling liquid was injected for 60 seconds. The injection angle of the cooling liquid was 0°. As a result of this kind of hardening treatment, an incompletely hardened structure (a bainite structure) was observed at a portion of the structure of the annular workpiece. Also, the roundness of the annular workpiece after the hardening treatment was 160 μm.

In Reference example 2, first, the roundness of an annular workpiece (a test piece having a thickness of 10 mm) before heating was calculated. The roundness was 140 μm. Next, the annular workpiece was transported to the induction heating zone 210 of the hardening device 300 (see FIG. 4B) having the induction heating zone 210, the outer periphery analyzing zone 220, and the cooling zone 230, and the entire annular workpiece was heated to 950° C. Here, the heating condition was a frequency of 1 kHz and a heating time of 30 seconds. The temperature of the annular workpiece was measured just as it was in Example 6. At this time, the shape of the heated annular workpiece was generally elliptical when viewed in a plan view. Then, the annular workpiece was cooled to 750° C. by air cooling.

Continuing on, the annular workpiece that had been cooled to 750° C. after being heated to the hardening temperature was moved to the outer periphery analyzing zone 220, where it was divided into large diameter portions and small diameter portions, and information regarding this division was then stored in the storage element 223. Here, the same method employed with Example 1 was employed as the method to divide the annular workpiece into large diameter portions and small diameter portions.

Next, the annular workpiece was moved to the cooling zone 230, and the annular workpiece was cooled just as in Example 6, except that the cooling condition (the injection condition of the cooling liquid) was changed as described below. At the small diameter portions, cooling liquid started to be injected at a flowrate of 1.1 L/min per one injection nozzle, from both the injection nozzles on the inner side and the injection nozzles on the outer side, one second after the temperature of the annular workpiece reached 750° C. by air cooling, and the cooling liquid was injected for 60 seconds. The injection angle of the cooling liquid was 0°. At the large diameter portions, cooling liquid started to be injected at a flowrate of 0.8 L/min per one injection nozzle, from both the injection nozzles on the inner side and the injection nozzles on the outer side, one second after the temperature of the annular workpiece reached 750° C. by air cooling, and the cooling liquid was injected for 60 seconds. The injection angle of the cooling liquid was 0°. As a result of this kind of hardening treatment, an incompletely hardened structure (a bainite structure) was observed at a portion of the structure of the annular workpiece. Also, the roundness of the annular workpiece after the hardening treatment was 150 μm.

With Comparative example 5, first, the roundness of an annular workpiece (a test piece having a thickness of 20 mm) before heating was calculated. The roundness was 150 μm. Next, the annular workpiece was put into a heating furnace, and furnace heated for 0.5 hours at 830° C.

Next, cooling treatment by oil cooling in which the annular workpiece is put into 80° C. cooling oil was performed. As a result of this kind of treatment, the internal structure of the annular workpiece became a martensitic structure with no incompletely hardened structure. Also, the roundness of the annular workpiece after the hardening treatment was 300 μm.

With Comparative example 6, first, the roundness of an annular workpiece (a test piece having a thickness of 20 mm) before heating was calculated. The roundness was 140 μm. Next, the annular workpiece was transported to the induction heating zone 210 of the hardening device 300 (see FIG. 4B) having the induction heating zone 210, the outer periphery analyzing zone 220, and the cooling zone 230, and the entire annular workpiece was heated to 950° C. Here, the heating condition was a frequency of 1 kHz and a heating time of 60 seconds. The temperature of the annular workpiece was measured just as it was in Example 6.

Next, the annular workpiece was moved to the cooling zone 230, and cooled by injecting cooling liquid under a predetermined condition toward the annular workpiece. Here, the annular workpiece was cooled by injecting cooling liquid under identical conditions from all of the injection nozzles. Cooling liquid started to be injected at a flowrate of 1.8 L/min per one injection nozzle, from all of the injection nozzles on the inner side and all of the injection nozzles on the outer side, one second after the end of heating to the hardening temperature (950° C.), and the cooling liquid was injected for 60 seconds. The injection angle of the cooling liquid was 0°. With this kind of hardening treatment, the internal structure of the annular workpiece became a martensitic structure with no incompletely hardened structure. Also, the roundness of the annular workpiece after the hardening treatment was 220 μm.

TABLE 2

| | Steel grade of test piece | Thickness (mm) | Roundness before heating (μm) | Heating condition | Analyzing process executing temperature (° C.) |
|---|---|---|---|---|---|
| Example 6 | SUJ2 | 15 | 100 | Induction heating 950° C.-60 sec | 600 *1 |
| Example 7 | ↑ | 20 | 150 | Induction heating 950° C.-60 sec | ↑ |
| Example 8 | ↑ | 10 | 120 | Induction heating 950° C.-30 sec | ↑ |
| Reference example 1 | ↑ | 20 | 150 | Induction heating 950° C.-60 sec | 750 *2 |
| Reference example 2 | ↑ | 10 | 140 | Induction heating 950° C.-30 sec | ↑ |
| Comparative example 5 | ↑ | 20 | 150 | Furnace heating 830° C.-0.5 h | — |
| Comparative example 6 | ↑ | 20 | 140 | Induction heating 950° C.-60 sec | — |

| | Cooling condition *3 Flowrate (L/min) *4 | Internal structure after hardening treatment | Roundness after hardening treatment (μm) | Roundness after hardening with respect to roundness before heating (after hardening/before heating) |
|---|---|---|---|---|
| Example 6 | 2.0<br>1.8 | Martensitic structure with no incompletely hardened structure | 120 | 1.2 |
| Example 7 | 2.2<br>1.8 | Martensitic structure with no incompletely hardened structure | 130 | 0.9 |
| Example 8 | 1.8<br>1.5 | Martensitic structure with no incompletely hardened structure | 100 | 0.8 |
| Reference example 1 | 2.0<br>1.5 | Martensitic structure with incompletely hardened structure at a portion | 160 | 1.1 |
| Reference example 2 | 1.1<br>0.8 | Martensitic structure with incompletely hardened structure at a portion | 150 | 1.1 |
| Comparative example 5 | —<br>(Put into cooling oil) | Martensitic structure with no incompletely hardened structure | 300 | 2.0 |
| Comparative example 6 | 1.8 | Martensitic structure with no incompletely hardened structure | 220 | 1.6 |

*1: The temperature reached during the rise in temperature to the hardening temperature.

*2: The temperature reached when cooling after heating to the hardening temperature.

*3: In the cooling conditions in Examples 6 to 8 and Comparative examples 1 and 2, the cooling condition of the small diameter portion is shown above, and the cooling condition of the large diameter portion is shown below.

*4: The flowrate in the cooling conditions in Examples 6 to 8 and Comparative examples 1 and 2 indicates the flowrate per one injection nozzle.

As shown in Table 2, with the hardening method according to the second example embodiment, it is evident that a hardened product with good roundness can be obtained. Therefore, with the hardening method according to the second example embodiment, a hardened product with good roundness can be provided at a low cost. Further, it is also possible to respond quickly to changes in the size and the like of an annular workpiece. Also, with the hardening method according to the second example embodiment, it is evident that a hardened product with good roundness can be obtained even with an annular workpiece to be hardened that has a thickness exceeding 10 mm.

What is claimed is:

1. A hardening method for an annular workpiece made of metal, comprising:

a heating process that heats the annular workpiece to a hardening temperature;

an analyzing process that obtains a diameter of the annular workpiece heated to the hardening temperature, and divides the heated annular workpiece into at least a small diameter portion and a large diameter portion based on the obtained diameter; and a cooling process that injects cooling liquid under an injection condition toward the annular workpiece that has been divided into at least the large diameter portion and the small diameter portion in the analyzing process such that a dimensional difference between the large diameter portion and the small diameter portion decreases, the injection condition for the large diameter portion being different from the injection condition for the small diameter portion, wherein in the cooling process, the injection condition of the cooling liquid is adjusted by changing at least one of an injection quantity of the cooling liquid per unit time, an injection start timing of the cooling liquid, and an injection angle of the cooling liquid; and the division of the large diameter portion and the small diameter portion is made through either process A or process B:

Process A:

determining a virtual center of the heated workpiece;

measuring each position in a circumferential direction of an outer periphery or an inner periphery of the heated workpiece;

obtaining a distance between the virtual center and each position in the circumferential direction of the outer periphery or the inner periphery of the workpiece;

converting the obtained distance into a coordinate data in a XY coordinates with the virtual center as an origin;

approximating the coordinate data by a method of least squares and calculating a circle which approximates an outer peripheral shape or an inner peripheral shape of the workpiece;

calculating a distance from a central coordinate of the approximate circle to each of the positions in the circumferential direction of the outer periphery or the inner periphery of the workpiece as a radius of each of the positions in the circumferential direction of the outer periphery or the inner periphery of the workpiece;

calculating a reference radius which divides the large diameter portion from the small diameter portion based on a first radius of a first virtual circle and a second radius of a second virtual circle, the first virtual circle being a circle which is centered around the central coordinate and in which a maximum value among the radii at the positions in the circumferential direction of the outer periphery or the inner periphery of the workpiece obtained is taken as a radius of the first virtual circle, the second virtual circle being a circle which is centered around the central coordinate and in which a minimum value among the radii at the positions in the circumferential direction of the outer periphery or the inner periphery of the workpiece obtained is taken as a radius of the second virtual circle;

calculating an average of the radius of the first virtual circle and the radius of the second virtual circle as a reference radius;

virtually dividing the work piece into a plurality of workpiece fragments such that central angles of the workpiece fragments in the circumferential direction of the first virtual circle or the second virtual circle are equal;

calculating an average value of the radii of the positions in the circumferential direction of the outer periphery or the inner periphery of the workpiece for each of the workpiece fragments;

dividing a workpiece fragment of which the average value of the radii is greater than the reference radius as a large diameter portion and dividing a workpiece fragment of which the average value of the radii is smaller than or equal to the reference radius as a small diameter portion;

Process B:

determining a virtual center of the heated workpiece;

measuring each portion in a circumferential direction of an outer periphery or an inner periphery of the heated workpiece;

obtaining a distance between the virtual center and each position in the circumferential direction of the outer periphery or the inner periphery of the workpiece;

converting the obtained distance into a coordinate data in a XY coordinates with the virtual center as an origin;

approximating the coordinate data by a method of least squares and calculating a circle which approximates an outer peripheral shape or an inner peripheral shape of the workpiece;

calculating a distance from a central coordinate of the approximate circle to each of the positions in the circumferential direction of the outer periphery or the inner periphery of the workpiece as a radius of each of the positions in the circumferential direction of the outer periphery or the inner periphery of the workpiece; virtually dividing the work piece into a plurality of workpiece fragments such that central angles of the workpiece fragments in the circumferential direction of the workpiece are equal;

calculating an average value of the radii of the positions in the circumferential direction of the outer periphery or the inner periphery of the workpiece for each of the workpiece fragments;

dividing a workpiece fragment of which the average value of the radii is greater than a radius of the approximate circle as a large diameter portion and dividing a workpiece fragment of which the average value of the radii is smaller than or equal to the radius of the approximate circle as a small diameter portion.

2. The hardening method according to claim 1, wherein the annular workpiece is made a martensitic structure with no incompletely hardened structure, by the cooling process.

3. The hardening method according to claim 1, wherein in the cooling process, the injection condition of the cooling liquid is adjusted such that cooling of the small diameter portion is promoted ahead of cooling of the large diameter portion.

4. The hardening method according to claim 1, wherein in the cooling process, the cooling liquid is injected from an inner side and an outer side of the annular workpiece.

5. The hardening method according to claim 1, wherein the each position in the circumferential direction of the outer periphery or the inner periphery of the heated workpiece is measured by a laser displacement sensor.

6. A hardening method for an annular workpiece made of metal, comprising:

a first heating process that heats the annular workpiece to a temperature at which stress in the annular workpiece is released;

an analyzing process that obtains a diameter of the annular workpiece heated to the temperature that releases stress, and divides the heated annular workpiece into at least a small diameter portion and a large diameter portion based on the obtained diameter;

a second heating process that heats the annular workpiece that has been divided into at least the large diameter portion and the small diameter portion in the analyzing process to a hardening temperature; and a cooling process that injects cooling liquid under an injection condition toward the annular workpiece that has been heated to the hardening temperature such that a dimensional difference between the large diameter portion and the small diameter portion decreases, the injection condition for the large diameter portion being different from the injection condition for the small diameter portion, wherein in the cooling process, the injection condition is adjusted by changing at least one of an injection quantity of the cooling liquid per unite time, an injection start timing of the cooling liquid, and an injection angle of the cooling liquid; and the division of the large diameter portion and the small diameter portion is made through either process A or process B:

Process A:

determining a virtual center of the heated workpiece;

measuring each position in a circumferential direction of an outer periphery or an inner periphery of the heated workpiece;

obtaining a distance between the virtual center and each position in the circumferential direction of the outer periphery or the inner periphery of the workpiece;

converting the obtained distance into a coordinate data in a XY coordinates with the virtual center as an origin;

approximating the coordinate data by a method of least squares and calculating a circle which approximates an outer peripheral shape or an inner peripheral shape of the workpiece;

calculating a distance from a central coordinate of the approximate circle to each of the positions in the circumferential direction of the outer periphery or the inner periphery of the workpiece as a radius of each of the positions in the circumferential direction of the outer periphery or the inner periphery of the workpiece;

calculating a reference radius which divides the large diameter portion from the small diameter portion based on a first radius of a first virtual circle and a second radius of a second virtual circle, the first virtual circle being a circle which is centered around the central coordinate and in which a maximum value among the radii at the positions in the circumferential direction of the outer periphery or the inner periphery of the workpiece obtained is taken as a radius of the first virtual circle, the second virtual circle being a circle which is centered around the central coordinate and in which a minimum value among the radii at the positions in the circumferential direction of the outer periphery or the inner periphery of the workpiece obtained is taken as a radius of the second virtual circle;

calculating an average of the radius of the first virtual circle and the radius of the second virtual circle as a reference radius;

virtually dividing the work piece into a plurality of workpiece fragments such that central angles of the workpiece fragments in the circumferential direction of the first virtual circle or the second virtual circle are equal;

calculating an average value of the radii of the positions in the circumferential direction of the outer periphery or the inner periphery of the workpiece for each of the workpiece fragments;

dividing a workpiece fragment of which the average value of the radii is greater than the reference radius as a large diameter portion and dividing a workpiece fragment of which the average value of the radii is smaller than or equal to the reference radius as a small diameter portion;

Process B:

determining a virtual center of the heated workpiece;

measuring each portion in a circumferential direction of an outer periphery or an inner periphery of the heated workpiece;

obtaining a distance between the virtual center and each position in the circumferential direction of the outer periphery or the inner periphery of the workpiece;

converting the obtained distance into a coordinate data in a XY coordinates with the virtual center as an origin;

approximating the coordinate data by a method of least squares and calculating a circle which approximates an outer peripheral shape or an inner peripheral shape of the workpiece;

calculating a distance from a central coordinate of the approximate circle to each of the positions in the circumferential direction of the outer periphery or the inner periphery of the workpiece as a radius of each of the positions in the circumferential direction of the outer periphery or the inner periphery of the workpiece;

virtually dividing the work piece into a plurality of workpiece fragments such that central angles of the workpiece fragments in the circumferential direction of the workpiece are equal;

calculating an average value of the radii of the positions in the circumferential direction of the outer periphery or the inner periphery of the workpiece for each of the workpiece fragments;

dividing a workpiece fragment of which the average value of the radii is greater than a radius of the approximate circle as a large diameter portion and dividing a workpiece fragment of which the average value of the radii is smaller than or equal to the radius of the approximate circle as a small diameter portion.

7. The hardening method according to claim 6, wherein the annular workpiece is made a martensitic structure with no incompletely hardened structure, by the cooling process.

8. The hardening method according to claim 6, wherein in the cooling process, the injection condition of the cooling liquid is adjusted such that cooling of the small diameter portion is promoted ahead of cooling of the large diameter portion.

9. The hardening method according to claim 6, wherein in the cooling process, the cooling liquid is injected from an inner side and an outer side of the annular workpiece.

10. The hardening method according to claim 6, wherein the each position in the circumferential direction of the outer periphery or the inner periphery of the heated workpiece is measured by a laser displacement sensor.

* * * * *